US012383079B2

(12) United States Patent
Goehring

(10) Patent No.: US 12,383,079 B2
(45) Date of Patent: Aug. 12, 2025

(54) SPACE SAVING MANUAL SHELF MANAGEMENT SYSTEM

(71) Applicant: William R. Goehring, Wexford, PA (US)

(72) Inventor: William R. Goehring, Wexford, PA (US)

( * ) Notice: Subject to any disclaimer, the term of this patent is extended or adjusted under 35 U.S.C. 154(b) by 0 days.

(21) Appl. No.: 18/732,362

(22) Filed: Jun. 3, 2024

(65) Prior Publication Data

US 2024/0398135 A1 Dec. 5, 2024

Related U.S. Application Data

(60) Provisional application No. 63/470,283, filed on Jun. 1, 2023.

(51) Int. Cl.

| | |
|---|---|
| ***A47F 1/12*** | (2006.01) |
| ***A47F 5/00*** | (2006.01) |
| ***A47F 5/10*** | (2006.01) |
| ***A47F 7/00*** | (2006.01) |

(52) U.S. Cl.

CPC ..... *A47F 1/125* (2013.01); *A47F 5/0018* (2013.01); *A47F 5/105* (2013.01); *A47F 7/0007* (2013.01)

(58) Field of Classification Search

CPC ..... A47F 1/125; A47F 5/0018; A47F 5/105; A47F 7/0007; A47F 2005/165; A47B 96/04

USPC ..... 211/59.3, 59.2, 184

See application file for complete search history.

(56) References Cited

U.S. PATENT DOCUMENTS

| | | | | | |
|---|---|---|---|---|---|
| 870,993 | A | * | 11/1907 | Richardson | A47B 61/04 211/184 |
| 1,702,987 | A | * | 2/1929 | Wilson | A47F 1/125 211/59.3 |
| 2,079,754 | A | * | 5/1937 | Waxgiser, V | A47F 1/125 211/59.3 |
| 2,098,844 | A | * | 11/1937 | Waxgiser, V | A47B 81/007 211/59.3 |
| 4,830,201 | A | * | 5/1989 | Breslow | A47F 1/126 211/59.3 |

(Continued)

FOREIGN PATENT DOCUMENTS

| | | |
|---|---|---|
| WO | 2006019947 | 2/2006 |
| WO | 2022035823 | 2/2022 |

*Primary Examiner* — Jennifer E. Novosad

(74) *Attorney, Agent, or Firm* — Blynn L. Shideler; Krisanne Shideler; BLK Law Group

(57) ABSTRACT

A bottom supporting shelf allocation and management system for rows of products includes adjacent shelf allocating and managing units. Each unit includes a shelf supported base supporting at least one row of products, and a perpendicular side divider extending vertically above the base. The side divider is removeably attached to a base side edge where the coupling locks the side divider and base in a fixed lateral and vertical position but enables the side divider to manually slide forward and backward along the base. A backstop is attached to the rear of the side divider protruding laterally across the base. The backstop, when the side divider is manually brought forward, makes contact with a rearmost product resting on the base and will push the rearmost product and any other products on the base forward in sympathy with the forward movement of the side divider.

10 Claims, 7 Drawing Sheets

(56) References Cited

U.S. PATENT DOCUMENTS 4,901,869 A * 2/1990 Hawkinson ..... A47F 1/126 211/59.3
5,123,546 A * 6/1992 Crum ..... A47F 1/126 206/556
5,161,702 A * 11/1992 Skalski ..... A47F 1/126 211/59.3
5,411,146 A * 5/1995 Jarecki ..... A47F 5/0056 211/184
5,413,229 A * 5/1995 Zuberbuhler ..... A47F 1/125 211/59.3
5,469,976 A * 11/1995 Burchell ..... A47F 1/125 211/59.3
5,613,621 A * 3/1997 Gervasi ..... G07F 11/38 221/6
6,129,218 A * 10/2000 Henry ..... A47F 5/005 211/59.3
6,155,438 A * 12/2000 Close ..... A47F 1/125 211/DIG. 1
6,227,386 B1 * 5/2001 Close ..... A47F 1/125 211/59.3
6,375,015 B1 * 4/2002 Wingate ..... A47F 1/126 211/59.3
6,523,703 B1 * 2/2003 Robertson ..... A47F 1/126 211/59.3
6,527,127 B2 * 3/2003 Dumontet ..... A47F 1/125 211/59.3
6,719,151 B2 * 4/2004 Close ..... A47F 1/12 211/119.003
7,124,897 B2 * 10/2006 Bustos ..... B65D 19/44 211/59.3
7,931,156 B2 * 4/2011 Hardy ..... A47F 1/126 211/59.3
7,992,726 B2 * 8/2011 Goehring ..... A47F 1/12 211/184
8,066,128 B2 * 11/2011 Crawbuck ..... A47F 1/125 211/59.3
8,113,360 B2 * 2/2012 Olson ..... A47F 5/005 211/59.3
8,851,303 B2 * 10/2014 Crawbuck ..... A47F 1/126 211/59.3
8,910,802 B2 * 12/2014 Hardy ..... A47F 5/005 211/59.3
8,997,997 B2 * 4/2015 Close ..... A47F 1/125 206/804
9,055,828 B2 * 6/2015 Burchell ..... A47F 1/125
9,198,527 B2 * 12/2015 Goehring ..... A47F 1/12
9,265,362 B2 * 2/2016 Hardy ..... A47F 1/125
9,398,817 B2 * 7/2016 Daw ..... A47F 1/00
9,445,675 B1 * 9/2016 DeSena ..... A47F 1/126
9,901,191 B1 * 2/2018 Schmidt ..... A47F 1/126
9,907,413 B2 * 3/2018 Goehring ..... A47F 5/0025
10,555,623 B2 * 2/2020 Kologe ..... A47B 57/58
10,772,424 B2 * 9/2020 Turner ..... A47B 57/58
10,959,541 B2 * 3/2021 Everett ..... A47F 1/126
11,134,797 B2 * 10/2021 Goehring ..... A47F 5/0025
12,121,159 B2 * 10/2024 Goehring ..... A47F 5/005
2002/0145004 A1 * 10/2002 Bennett ..... A47F 5/11 221/311
2005/0098515 A1 * 5/2005 Close ..... A47F 7/28 211/59.3
2005/0258113 A1 * 11/2005 Close ..... A47F 1/125 211/59.3
2006/0076301 A1 * 4/2006 Caterinacci ..... A47F 1/125 211/59.3
2007/0068885 A1 * 3/2007 Busto ..... A47F 1/125 211/59.3
2007/0158281 A1 * 7/2007 Hardy ..... A47F 1/125 211/59.3
2009/0084745 A1 4/2009 Goehring
2010/0096345 A1 * 4/2010 Crawbuck ..... A47F 1/125 211/59.3
2011/0147323 A1 * 6/2011 Sainato ..... A47F 1/12 40/642.02
2012/0204458 A1 * 8/2012 Goehring ..... A47F 1/125 206/229
2014/0124463 A1 5/2014 Goehring
2017/0020302 A1 1/2017 Goehring
2018/0055250 A1 * 3/2018 Schmidt ..... A47F 3/14
2018/0160823 A1 * 6/2018 Graber ..... A47F 1/126
2018/0249848 A1 * 9/2018 Goehring ..... A47F 5/005
2023/0200562 A1 6/2023 Goehring
2023/0337839 A1 * 10/2023 Walker ..... A47F 1/126
2024/0398135 A1 * 12/2024 Goehring ..... A47F 5/0018

* cited by examiner

Fig. 5
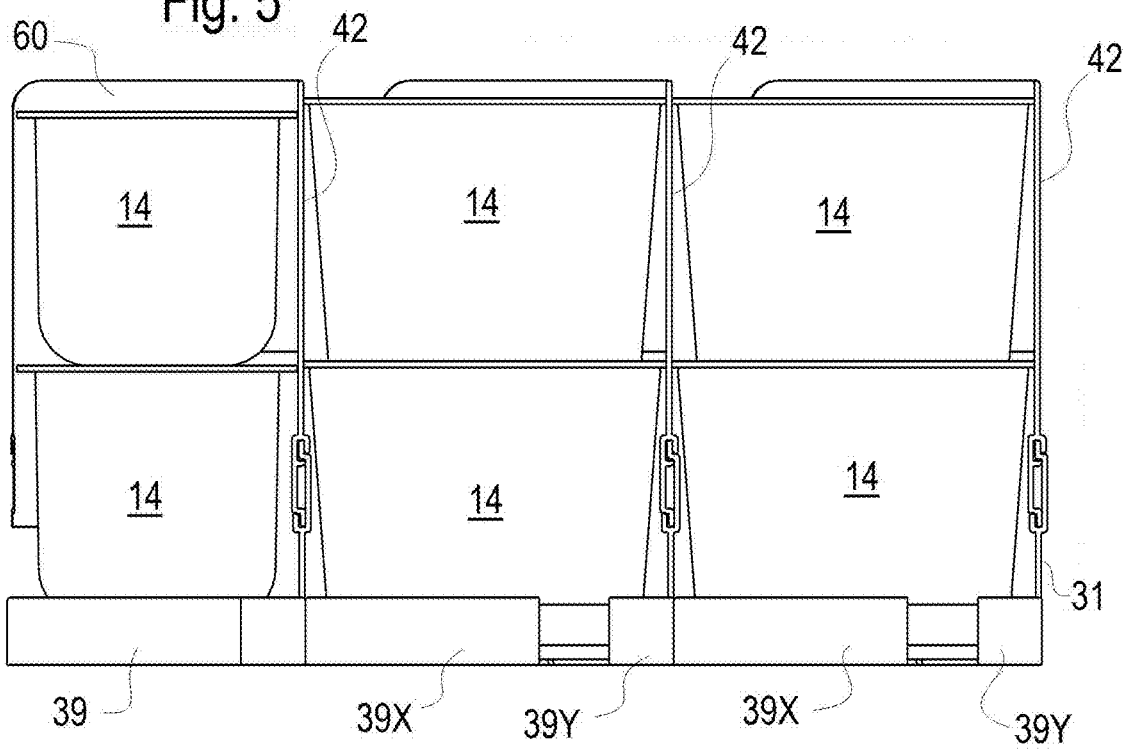
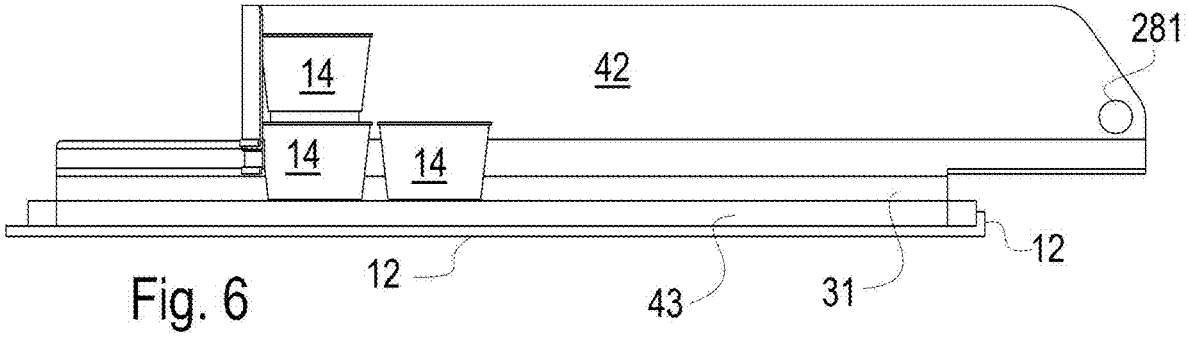
Fig. 6

Fig. 8
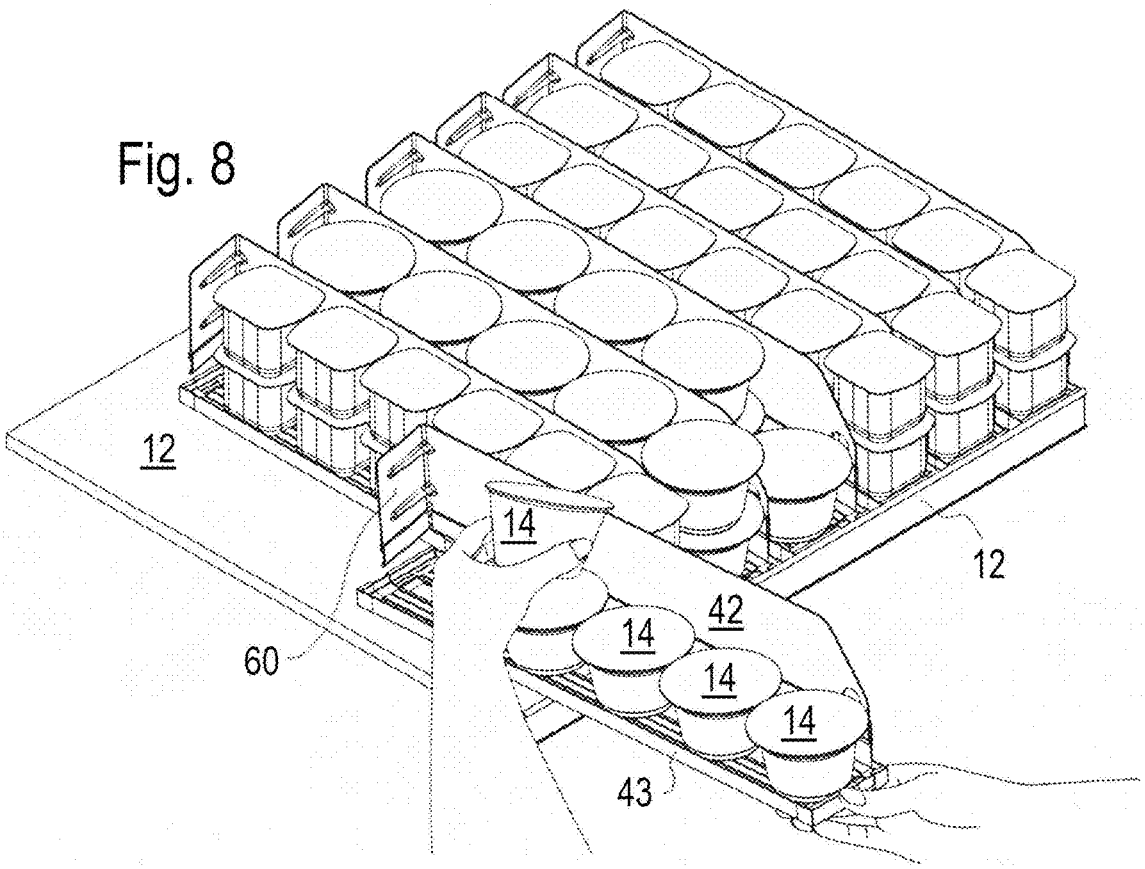
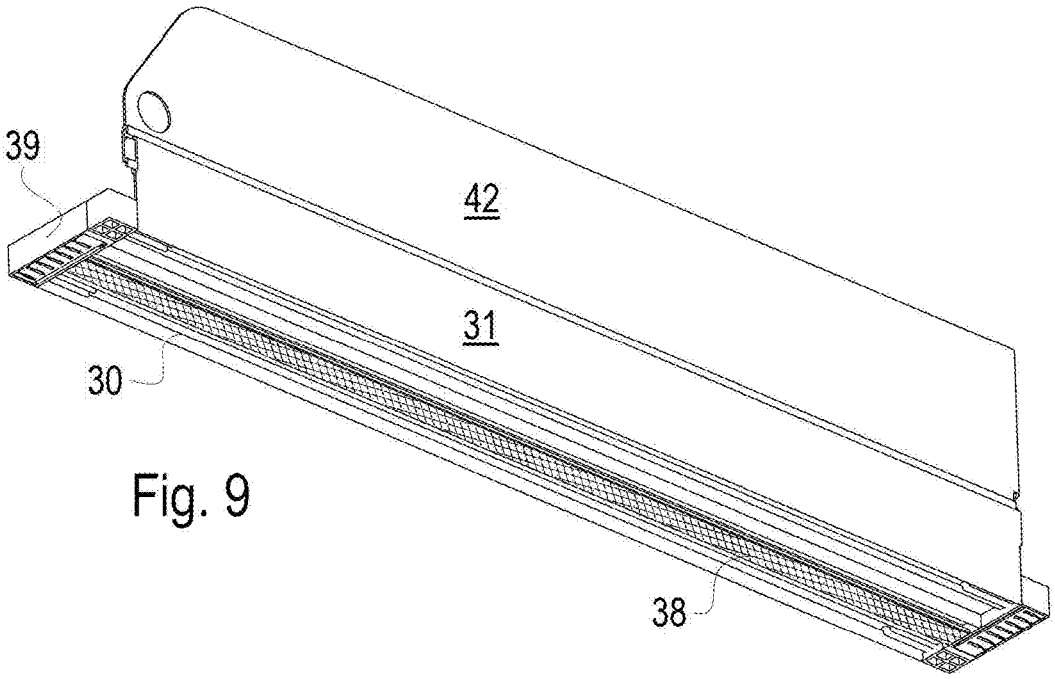
Fig. 9

SPACE SAVING MANUAL SHELF MANAGEMENT SYSTEM

RELATED APPLICATIONS

The present invention claims the benefit of U.S. Provisional Patent Application Ser. No. 63/470,283 filed Jun. 1, 2023 titled "Space Saving Manual Shelf Management System", which application is incorporated herein by reference.

BACKGROUND OF THE INVENTION

1. Field of the Invention

The present invention relates to manual shelf management systems, and more specifically to a space saving, manual, modular, bottom containing and laterally supporting, substantially extrudable, shelf management system.

2. Background Information

Labor inefficiencies and other problems result when merchandise is displayed on retail store shelves with neither rigid dividers nor a method to bring product forward on the shelf into selling position (a process called "fronting") without handling the merchandise piece-by-piece. These problems pertain to grocery stores and other retail stores where consumer packaged goods, such as food products, spray paint cans and health and beauty care products, are displayed for sale on store shelves.

With no rigid dividers store personnel must, during product stocking, form rows by approximating straight lines and then manually finessing products into straight rows. This process is imprecise and time consuming. Further, as new merchandise is fed into rows from the front of the shelf, packages in the middle of the row tend to move to the left or right (known as "snaking") causing packages in the middle or back of the row to be significantly out of alignment with those at the front. This results in wasted labor as store personnel must handle the merchandise multiple extra times to position products in proper alignment. Another result is shelf disorganization that degrades the shopping experience by making it difficult for shoppers to locate and reach/grasp merchandise. Merchandise is generally selected by the consumer from the front of the shelf and store personnel are constantly fronting the merchandise, i.e. bringing merchandise from the middle and rear of the shelf forward into selling position. The vast majority of store shelves are fronted using the legacy practice where store clerks manually grasp individual packages and pull them forward. This manually intensive practice is time consuming and can be counter-productive because, as the store clerk reaches with his hand into the shelf to grasp packages, adjacent merchandise is sometimes knocked out of position which requires the clerk to then re-position that disrupted merchandise before the fronting procedure is completed. Further, the piece-by-piece fronting method is ineffective as typically only one or two items may be easily brought forward into selling position leaving merchandise at the middle and rear of the shelf out of shopper view and inaccessible.

The patent literature teaches effective shelf management systems to alleviate the problems discussed above. The applicant has developed a series of manual effective shelf management systems that are helpful in describing the state of the art in this area. These include U.S. Patent Publication Numbers 2009-0084745, 2012-0204458, 2014-0124463, 2017-0020302, 2018-0249848 and 2023-0200562 and U.S. Pat. Nos. 7,992,726; 9,198,527, 9,907,413, and 11,134,797, which patent applications and patents are incorporated herein by reference.

One of these references from the applicant, U.S. Pat. No. 9,907,413 (hereinafter the '413 patent), discloses effective manual shelf management systems for use on retail store shelves, especially on grocery store shelves. One of the '413 patent systems, referenced herein as the "grocery family" of systems, features generally lower dividers (e.g. 1" to 3" in height) designed to work with products that are either unstacked or are stacked yet stable when stacked. These "grocery family" systems are best seen in FIGS. 9A, 9E and 11 of the '413 patent. Another family of systems disclosed in the '413 patent, referenced herein as the "yogurt family", has higher dividers (e.g. 5" to 7") that are required to laterally support stacked products (such as single-serve yogurt cups) where the product stack is unstable therefore needing a higher divider to provide sufficient lateral support (to prevent tipping). See FIGS. 6A, 6B and 7C of the '413 patent for examples of "yogurt family" systems.

One of these references from the applicant, U.S. Pat. No. 11,134,797 (hereafter '797 patent), also discloses effective shelf management systems for use on retail store shelves, especially on grocery store shelves. The '797 patent also provides a helpful understanding of the state of the art. The '797 patent discloses exclusively a "yogurt family" shelf management system with higher dividers to contain stacks of single-serve yogurt cups.

The invention of the present application as detailed below primarily pertains to "yogurt family" manual shelf management systems. The '413 and '797 patents disclose yogurt family shelf management systems for use on retail store shelves, especially including dairy shelves which generally display a distinct type of package where the top of the container is substantially wider than the base (i.e., a frustoconical shape). The yogurt family systems disclosed in the '413 patent and '797 patent, which are comprised of individual shelf management units, provide effective row separation, provide lateral support for product rows and allow for easy and rapid row fronting. Further, the yogurt family systems of both patents maintain straight product rows and establish positive row separation which together enhance the shopping experience by facilitating product identification and access. Further, the positive row separation prevents co-mingling of products on the shelves (where an item moves from its designated row into a different adjacent row) which causes extra work for store clerks, leads to difficulty in determining how much of a given item is stocked on the shelf, and can lead to items becoming "lost" on the shelf such that they do not sell before their expiration date. Neither the '413 patent nor the '797 patent attaches to the shelf with mechanical fasteners or permanent adhesives making installation fast and easy. Further, because the systems are not attached to the shelf, new product cut-ins and merchandise reconfigurations (called re-sets) are easy to accomplish. As the systems of both patents are comprised of individual trays or bases that support individual product rows, re-setting of merchandise is made easier as the units of this system, while loaded with merchandise, can be lifted off and away from the shelf and repositioned on a different shelf location in the store. Further both the '413 and '797 systems are easy to manufacture and low-cost systems.

A limitation of the '413 patent systems is a lack of features that allow width adjustment so that, during installation, the system could more intuitively and rapidly be adapted to yogurt cups (and other containers) of varying widths. The yogurt family systems of the '413 patent feature a fixed-width design where the yogurt containers are intended to hang off the open side of the unit. While this is an effective way to achieve the systems very important aim to minimize lateral disruption of rows, this design requires a non-intuitive installation process which can sometimes lead to more complicated and time-consuming installation and also installation errors. A further limitation of the '413 patent is that the "bend and riser" sliding mechanism feature, whereby the bottom of the divider (which also serves as a manual puller) is elevated above a high front shelf lip, is vulnerable to being fouled with spilled yogurt and other dirt.

A limitation of the '797 patent systems is that it features a free-floating puller and backstop that store management suggests is susceptible to become separated from the unit thereby rendering the unit non-functional (despite the fact that, in actual practice, this rarely happens). A further limitation of the '797 patent is that the combination of the thicknesses of the high side divider plus the free-floating puller may cause lateral disruption of the desired position of product rows on the shelf.

It is the object of the present invention to address the deficiencies of the prior art shelf management systems, while maintaining their advantages (particularly those of the '413 and '797 patent as much as possible), and provide a highly effective, easy and fast to install, easy to use and maintain shelf management system which causes the least amount of disruption possible to a store's preferred row positioning.

SUMMARY OF THE INVENTION

The present invention maintains all of the advantages presented by both the '413 and '797 patents shelf management systems, including rigid dividers that provide positive row segregation, lateral support to the products, an integral fronting mechanism which allows rapid merchandise fronting, a floating tray design where product rows are positioned on top of the tray thereby allowing product rows to be easily repositioned to the left or right or to be moved to another shelf location altogether, and the ability to accommodate products of varying widths. A manual shelf management system incorporating all of these features will be referenced herein as a "foundational shelf management system".

One aspect of the present invention provides a foundational shelf management system that may be described as a manual bottom-supporting shelf allocation and management system for allocating shelf space among rows of products. The system includes a plurality of adjacent shelf allocating and management units, each unit associated with at least one row of products. Each unit includes a base adapted to rest on a shelf and to support the at least one row of products, a perpendicular (high) side divider attached to a side edge of the base where the side divider is configured to slide forward and backward along the stationary base, and a backstop attached to the rear of the side divider and protruding laterally across the base (at a substantially perpendicular angle to the side divider), which is configured, when the side divider is drawn forward, to make contact with a rearmost product resting on the base and to push the rearmost product and any other products on the base forward with the forward movement of the side divider.

A further aspect of the present invention is an anti-fouling base and divider coupling mechanism that attaches the high divider to the base in a manner that allows the high divider to slide forward and backward along the base yielding a divider-as-puller configuration. The anti-fouling base and divider coupling mechanism is configured to be less susceptible to fouling by spilled yogurt or other dirt than other sliding coupling arrangements.

A further aspect of the present invention is a shelf allocation and management unit with a high divider on one side and substantially no divider (none or a very low divider) on the opposite side so that the unit may cause the least amount of lateral disruption to the preferred product row positions and so that the unit may be easily stocked from the side. This single divider design allows for no POG disruption and allows easy side stocking.

A further aspect of the present invention is a base and divider coupling mechanism that raises the bottom of the high divider so that it may be drawn forward over, without making contact with, a high lip on the front of a shelf during the row fronting operation. This allows the divider-as-puller construction to be configured to work with high front shelf lip.

A further aspect of the present invention includes a base that is adjustable in width allowing for the shelf allocation and management unit to accommodate a range of product widths and further allowing for the unit to be installed with minimal complication and time required. The system may further feature width adjustment mechanisms located on the front and rear distal end of the units which are simple to use thereby allowing intuitive and fast adjustment and installation of the system.

A further aspect of the present invention is an optional low side divider attached to a side edge of the base opposite the side to which the high side divider is attached where the low divider provides sufficient lateral support to prevent products from sliding off the side of the base to which the low divider is attached, and yet is low enough that it exists within the gap that naturally occurs between product rows and therefore does not displace substantial lateral space on the shelf. Specifically the low divider is only approx. 0.30" high effectively maintaining open-side design.

A further aspect of the present invention is a shelf allocation and management unit with a rigid base so that the unit, even when loaded with product, may be pulled part way off the shelf to allow stocking from the side without fear that the base will flex causing the product containers to spill out. This rigid base configuration allows a clerk to pull the unit forward partially off the shelf and stock from the side.

A further aspect of the present invention is a backstop that is shaped so that it makes more even contact with packages that do not have straight sides but rather are frusto-conical in shape so that when the backstop contacts these packages the force of contact is distributed evenly along the side of the container so that the container moves forward evenly rather than tipping over. In other words the backstop is preferably shaped to correspond to yogurt cup shape for yogurt applications.

A further aspect of the present invention is a base and width adjusting mechanism that are configured so that there are fewer convoluted crevices and indentations into which spilled yogurt might seep thereby allowing for a shelf allocation and management unit that is easier to clean. This yields an easy to clean design and increases the useful life of the product as well as user acceptance.

A further aspect of the present invention is a base underside that features anti-skid and/or magnetic material that helps to keep the units in proper position when inadvertently bumped (such as during stocking or shopping) and further helps prevent unwanted movement of the units during the row fronting operation.

These and other advantages of the present invention will be clarified in the following description taken together with the accompanying drawings.

BRIEF DESCRIPTION OF THE DRAWINGS

FIG. 5 is a front elevation schematic view of several side-by-side shelf allocation and management units each filled with merchandise and further showing that only a single and very thin divider separates the product rows:

FIG. 6 is a schematic view of an individual shelf allocation and management unit with features that elevate the bottom of the divider/puller to a high enough position so that it can be drawn over a high lip at the front of a shelf;

FIG. 8 is a schematic perspective view of the shelf allocation and management system showing the modular nature of the system and showing that an individual unit of the system may be pulled partially off the shelf allowing the operator to access the open side of the unit so that she may place new stock at the middle or rear of the unit to achieve proper stock rotation; and FIG. 9 is a view of the underside of a shelf allocation and management unit showing attached magnetic strips;

DESCRIPTION OF THE PREFERRED EMBODIMENTS

Figure 1A:
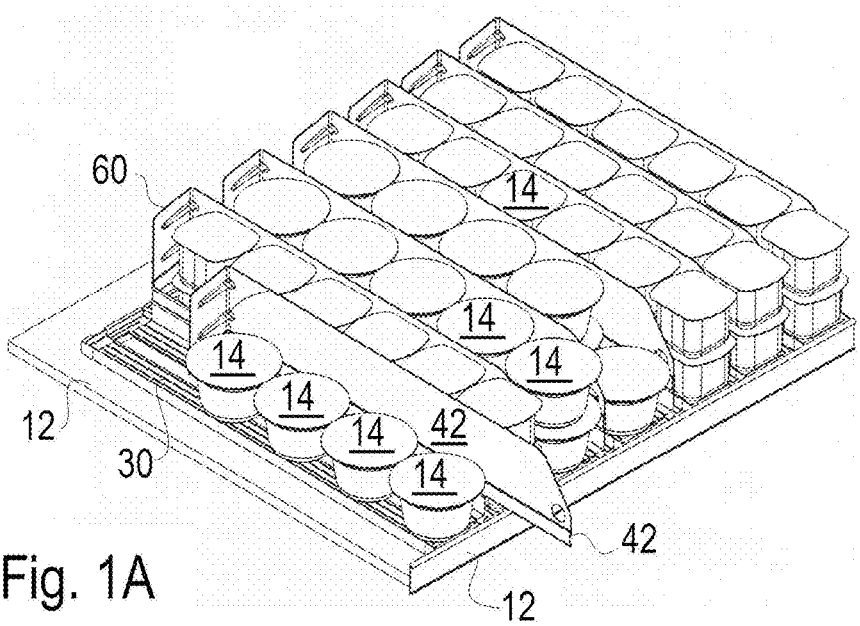
FIGS. 1A and B are schematic perspective views of the shelf allocation and management system showing manual fronting operation of the system and showing the modular nature of the system and a re-setting operation using the system.

It is noted that, as used in this specification and the appended claims, the singular forms "a," "an", and "the" include plural referents unless expressly and unequivocally limited to one referent. For the purposes of this specification, unless otherwise indicated, all numbers expressing parameters used in the specification and claims are to be understood as being modified in all instances by the term "about." The terms "about" or "approximate" or similar terms within this application will generally mean within 10% unless otherwise noted. Accordingly, unless indicated to the contrary, the numerical parameters set forth in the following specification and attached claims are approximations that may vary depending upon the desired properties sought to be obtained by the present invention. The various embodiments and examples of the present invention as presented herein are understood to be illustrative of the present invention and not restrictive thereof and are non-limiting with respect to the scope of the invention.

The broad concepts of the operation of the shelf management system 10 of the present invention, which is a foundational shelf management system as defined above, are found in U.S. Pat. No. 9,907,413, referenced herein as the '413 patent, which issued on Mar. 6, 2018, and in U.S. Pat. No. 11,134,797, which issued on Oct. 5, 2021, referenced herein as the '797 patent. Both patents are incorporated herein by reference. The present application utilizes some common reference numerals as found in the '413 patent and the '797 patent. The following disclosure will describe foundational shelf management system 10 of the invention which includes improvements to both the '413 and the '797 patent type foundational shelf management systems. One fundamental aspect of the present invention as detailed below is the unique combination of a bend and riser base and divider coupling mechanism with a width-adjustable base.

Analogous to the systems of the '413 and the '797 patents, the system 10 of the present invention is designed to be positioned on a retail store shelf and the units 20 of the system 10 are generally as long as the shelf is deep and are arranged perpendicular to the front shelf edge. Merchandise containers 14, are positioned on top of and inside of the units 20, so that the merchandise 14 placed inside of the unit 20, to the highest extent possible, is in the same position on the shelf 12 as it would be were no shelf allocating and management system 20 present. Put another way, among the chief aims of the present invention is that merchandise 14 placed in and on the units 20 should conform in position to what is dictated by the store's planogram (which is a chart specifying the exact shelf position of merchandise in a retail store). Ideally, the system 20 should not change that specified position.

Figure 1B:
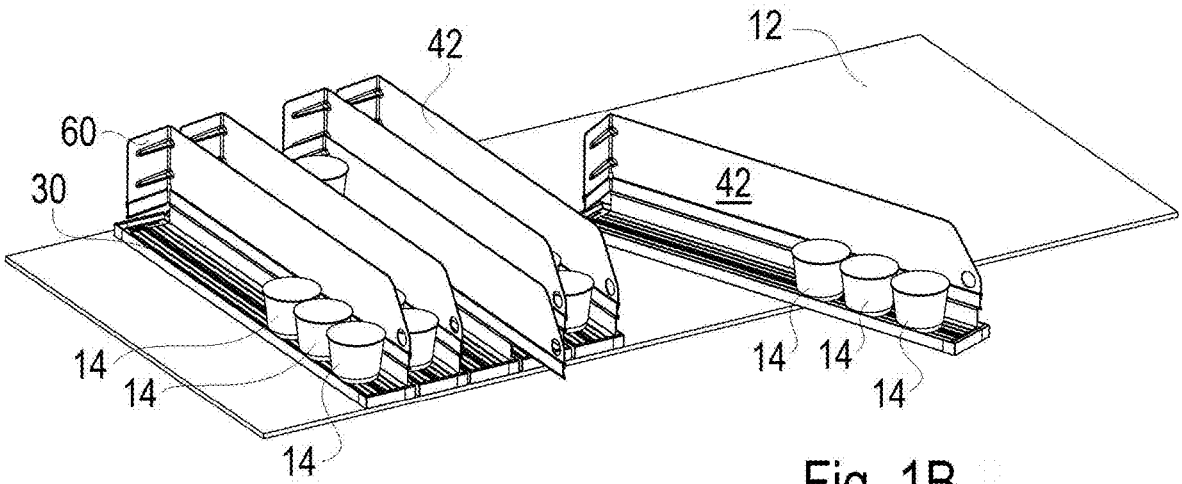
Figure 2A:
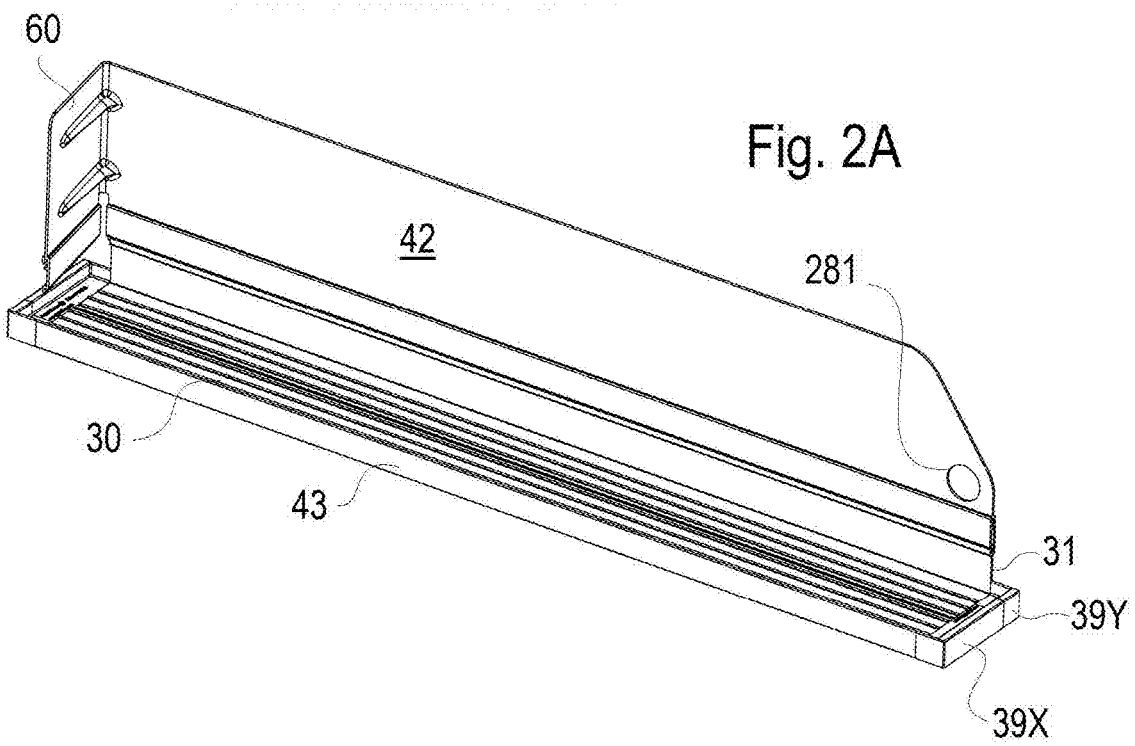
FIG. 2A is a schematic view of an individual shelf allocation and management unit; also shown is a base of the unit that is generally smooth and flat and devoid of crevices which would make the cleaning of spilled yogurt and other debris difficult.
Figure 2B:
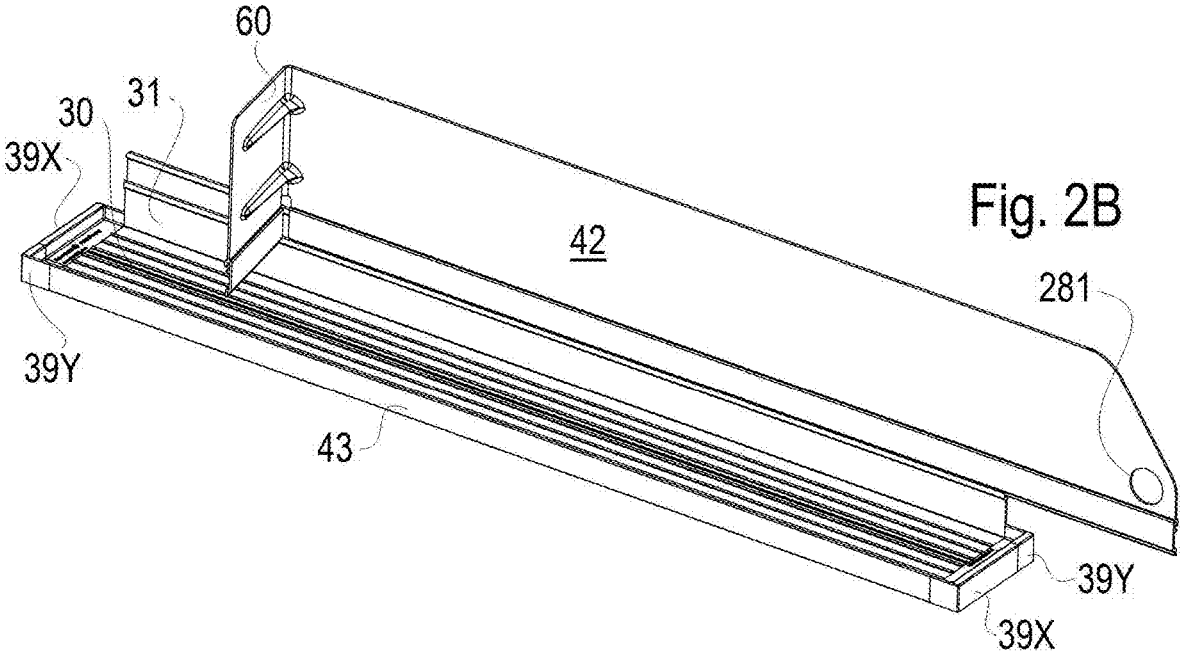
FIG. 2B is a schematic view of the shelf allocation and management unit shown in FIG. 2A but also showing the divider/puller in a partially forward position.
Figure 3:
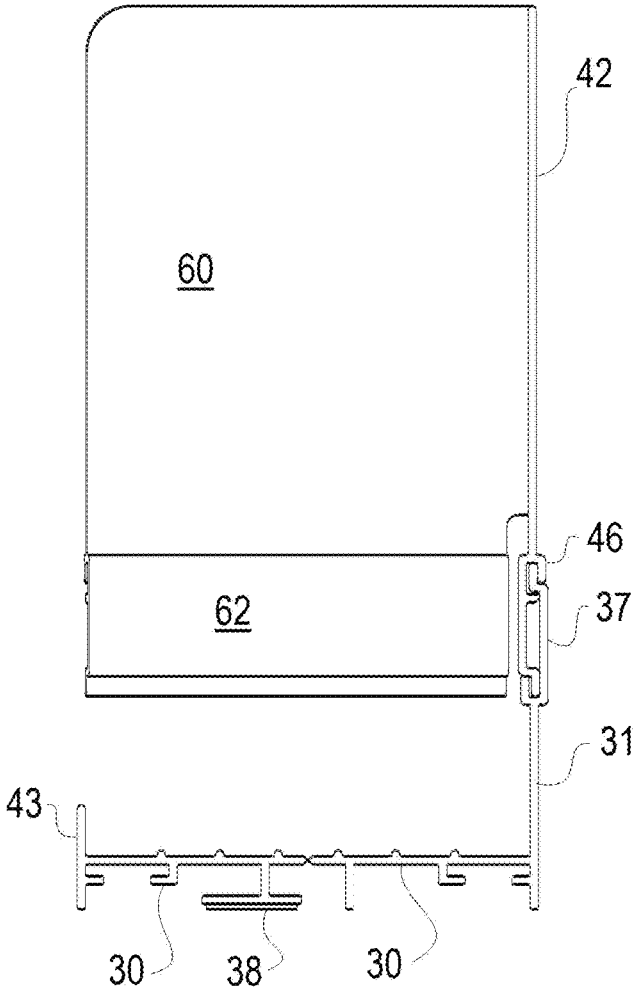
FIG. 3 is a cross section view of an individual shelf allocation and management unit according to the present invention.

The present invention, as shown in FIGS. 1A, 1B & 2A, provides a base 30 with a single high divider/puller 42 attached to the right side edge of base 30. A low divider 43 is attached to the side edge of base 30 opposite the side to which high divider/puller 42 is attached. The position of the high divider/puller on the left or the right side of base 30 is not really important as long as the high divider/puller 42 is one side of base 30 and the low divider 43 is on the opposite side. High divider/puller 42 is generally approx. 4" to 7" high or high enough to provide effective lateral support to yogurt cups (and other similar containers) that are typically stacked 2-high and 3-high and where these product 14 stacks are unstable and so need to be laterally supported to prevent sideways tipping of the product stack and further to positively separate one row from the next so that stocking or fronting of one row does not interfere with the products positioned in an immediately adjacent row. As shown in FIG. 3, low divider 43 is approximately 0.30" high, or generally between 0.10" and 1.00" high. Namely just high enough to prevent yogurt cups and other containers from sliding off the side of the base opposite the side to which the high divider/puller 42 is attached, but not so high as to cause lateral displacement of merchandise 14 rows. With this defined low height, low divider 43 will almost always exist in the gap presented when two yogurt containers are side-by-side.

While a single unit 20 as described above (with a single high divider/puller 42) would provide only partial lateral support to stacked yogurt cups merchandised on that unit 20, because, as seen in FIGS. 5 and 8, a unit 20 is most always installed as part of a series of side-by-side units 20, where each unit 20 is immediately adjacent to a unit 20 both on the left side and right side, products 14 merchandised on the subject unit 20 are laterally supported on the right by the high divider/puller 42 of the subject unit and are supported on the left by the high divider/puller 42 of the unit 20 immediately adjacent and to the left of the subject unit 20.

Figure 2C:
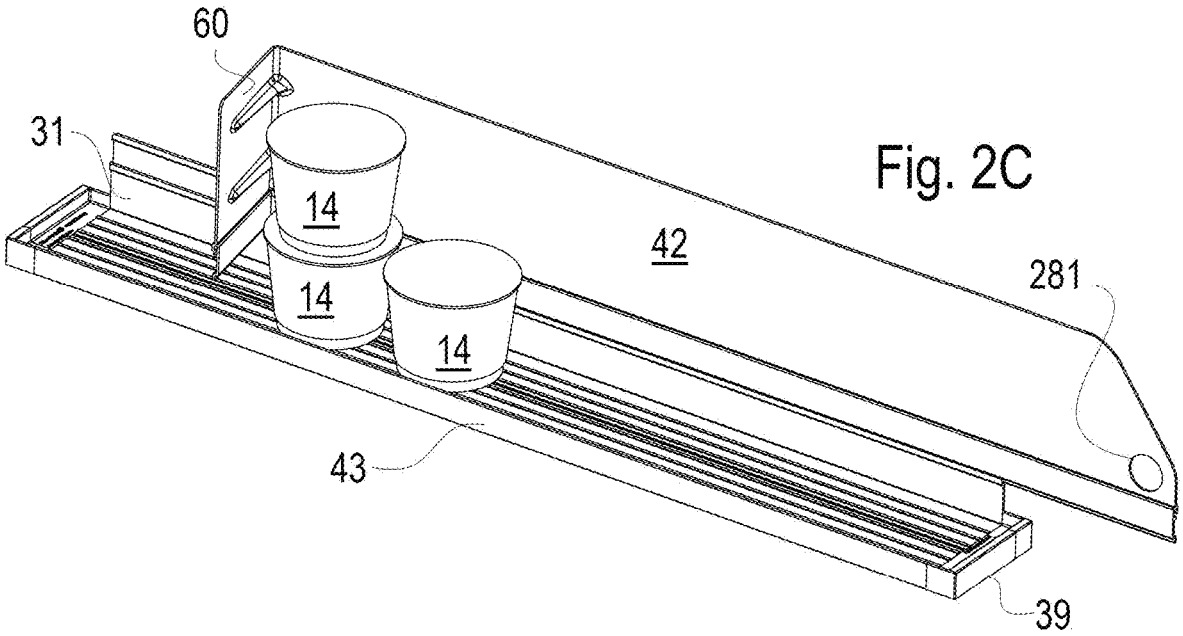
FIG. 2C is a schematic view of the same individual unit shown in FIG. 2B but also showing yogurt cups positioned on the unit.

The elements of the system 10 that allow the high divider 42 to also serve as the manual puller are shown in FIGS. 2C and 3. Base 30 features an integral fixed elevating rail 31 where elevating rail 31 is fixedly attached to the side edge of base 30 and where elevating rail 31 protrudes vertically and at a right angle from the side edge of base 30. This allows the bottom of high divider/puller 42 to be drawn forward and over (without crashing into) a high lip at the front of the shelf (typically approx. 0.30" high). Elevating rail 31 extends vertically approx. 0.70", and generally it may extend from approx. 0.40" to 1.50". Many store's yogurt sections, or yogurt cases, use shelves that have a front lip that extends approx. 0.30" vertically from the shelf surface, so elevating the divider 42, which doubles as the puller, above this lip is important.

FIG. 3 is a cross section view of an individual shelf allocation and management unit 20 according to the present invention showing the height of a low divider 43 that is high enough to prevent merchandise 14 from sliding off of the side of the unit 20 yet low enough that access to the side of the unit 20 is not impeded for purpose of stocking; also shown is a mechanism 37/46 that connects the divider/puller 42 to the base 30 and showing that this connection is configured so that spilled yogurt and other dirt would run over and outside of rather than into the mechanism. As shown in FIG. 3, the top portion of elevating rail 31 features base coupling component 37 which is configured to couple with the bottom portion of high divider/puller 42. High divider/puller 42 is approximately 4.5" high, although generally this may range from approximately 2" to 10" high, depending on the products 14 to be merchandised. High divider/puller 42 includes a divider coupling component 46 which is designed to mate with base coupling component 37. Base coupling component 37 and divider coupling component 46 are configured so that high divider/puller 42 may slide backward and forward along elevating rib 31 (and therefore base 30) while high divider/puller 42 is prevented from moving either vertically or laterally.

As can be seen in FIG. 2A, the front of the high divider/puller 42 is swept back at an angle thereby proving lateral containment to the yogurt cups 14 at the front of the row while also allowing the shopper to better see the front of adjacent rows to the left and the right. As shown in FIGS. 2A and 2C, backstop 60 is attached to the rear end of high divider/puller 42 where backstop 60 protrudes at a substantially 90-degree angle from high divider/puller 42 and extends substantially (e.g. at least 80%) across the width of base 30.

In the present invention high divider/puller 42 serves as a manual puller, so when high divider/puller 42 is drawn forward, backstop 60 also comes forward and makes contact with the rearmost product 14 positioned on the unit 20 so that the rearmost product 14 and any products 14 in front of backstop 60 will come forward towards the front of the base 30 (and therefore towards the front of shelf 12). As shown in FIGS. 2A & 3A, the front of high divider/puller 42 features a grasp handle 281, which may be simply a small hole at the very front and bottom of high divider/puller 42 (or other feature that allows for a more secure grip), which makes it easier for the operator to securely grasp high divider/puller 42 when performing a fronting operation.

The design described above where the high divider/puller 42 effectively serves as both a divider providing positive row separation and a puller that is integral to the fronting mechanism is unique to the present invention. This "single divider" or "L" design is fundamental to the key feature where the present invention will cause the least possible lateral disruption to the position of product 14 rows on the shelf 12. This may be referred to as a "zero planogram disruption" design. Most other shelf allocation and management systems used in the yogurt section of a store employ a 2-divider design where each shelf allocation and management unit has both a high left-side and a high right-side divider. The effect of this prior art structure is that each row of yogurt is separated by two dividers. The accumulation of these dividers across an installation of a series of these 2-divider systems amounts to an objectionable amount of lateral shelf space occupied by the dividers to the point where a store is typically forced to eliminate rows of merchandise. The average thickness of a divider in a 2-divider system is 0.070", so the combination of the right divider of one unit with the left divider of a unit immediately adjacent and to the right would be 0.14". The regularly-occurring space between product rows in a typical yogurt case is ordinarily approx. 0.050", so if the combined divider thickness occupied by a 2-divider system is 0.14" then it is clear that one or several product rows—depending on the number of 2-divider units installed—would need to be removed to accommodate the 2-divider system.

The thickness of the high divider of the present invention is approximately 0.045" which is less than space that ordinarily occurs between product 14 rows (approx. 0.050") when no shelf allocating and management system is present. As shown in FIG. 5, the single divider feature of the present invention combines with the extremely thin divider thickness to present a unit 20 and a system 10 that causes the least amount of lateral disruption possible. With present manufacturing techniques and materials it is generally not possible to cost effectively manufacture a high divider with a wall thickness substantially less than 0.045" thick.

Further, the "2-divider" systems described above usually also feature a fronting mechanism that employs a puller arm that is a separate strip of plastic that runs in a track along the bottom of one of the dividers and where this puller arm is attached to a backstop at the rear. When the puller arm is manually drawn forward, the products are brought or drawn forward for fronting. This puller arm adds to the lateral space occupied by these competing systems and further add to the amount of lateral shelf space that they displace which may require the removal of additional rows of merchandise 14.

As shown in FIG. 5, the mechanism that couples elevating rail 31 and divider/puller 42 is vertically positioned deliberately to account for the gaps that exist between a wide variety of designs for yogurt cups 14. The placement of the coupling mechanism not only allows the divider/puller 42 to be drawn over a dairy shelf 12 with a high front lip (as shown in FIG. 6) but also positions the mechanism in the optimal place so that, accounting for a wide variety of yogurt cup shapes and sizes, the mechanism is situated in the gap presented between yogurt cups or jars 14 when they are side-by-side.

As seen in FIG. 8, the single-divider design of the present invention where one of the sides of the unit 20 is open helps the store properly rotate merchandise 14 because it allows clerks to access the open side of the unit 20 when stocking new merchandise 14. By accessing the open side, clerks can easily load fresh merchandise 14 directly into the middle and rear of the units 20 rather than the legacy rotation practice where clerks are forced to completely remove all product 14 from a unit (or from a bare shelf), then load the fresh product 14 (which is pushed to the rear) and then replace the original product 14 at the front of the row. Merchandise 14 rotation is crucial for yogurt and other perishable dairy products that expire after only a few weeks on the store shelf 12.

As seen in FIG. 8, the unit 20 may be grasped at the front of the base 30 and pulled part way off the shelf 12 (approx. 6" to 15") thereby exposing the open side of the unit 20. This allows a stock clerk to place fresh cups 14 behind the cups 14 that were already in the unit 20 thereby achieving proper product 14 rotation. In other words, placing new product 14 behind the existing products 14 allows the store to achieve first-in-first-out rotation. The base 30 design of the present invention is reinforced or stiffened to better accommodate this action and prevent sagging of the unit 20 in this operation. The base 30 of the present invention features specially designed support ribs that run along the base 30 underside which add stiffness to base 30 so that clerks may pull the unit 20 off the shelf approximately 8" to 14" without worrying that the base 30 will flex causing the yogurt cups to spill.

The units 20 of the present invention are designed foremost to merchandise single-serve yogurt cups 14 and similar containers (where the top of the container 14 is wider than the base of the container 14). These yogurt and other containers 14 come in a wide variety of widths.

The units 20 disclosed in the '797 patent accommodated various container shapes and widths with a feature whereby the base of the cups protruded slightly over the edge of the base 30 of the units 20, wherein the system 10 was functional even when a portion of the bases of the yogurt cups hung over the base 30. Yogurt and other dairy containers can generally be grouped into "narrow" and "wide" width groups, thus this feature allowed one fixed width unit 20 of the '797 patent to work with a variety of yogurt cups widths. The '797 system featured units 20 of two different widths, a "narrow" for smaller cups and a "wide" for larger cups. So, for example, the "narrow" size (with a base 30 width of 2.60") would work with the group of smaller yogurt cups ranging in width from 2.60" to 3.5", and the "large" size worked with cups 3.60" wide and larger. A problem occurred, however, whereby workers performing the installation of the units 20 had difficulty determining which fixed width unit 20 (either "narrow" or "wide") should go with which yogurt cup 14 width. This confusion caused the installations to be more complicated, to take longer and also caused installation errors—for example there were instances where a "wide" unit 20 was used with a narrow cup 14 with the result that the installed unit 20 was substantially wider than the cup 14 which caused a major lateral displacement (and planogram disruption) to occur.

Figure 4A:
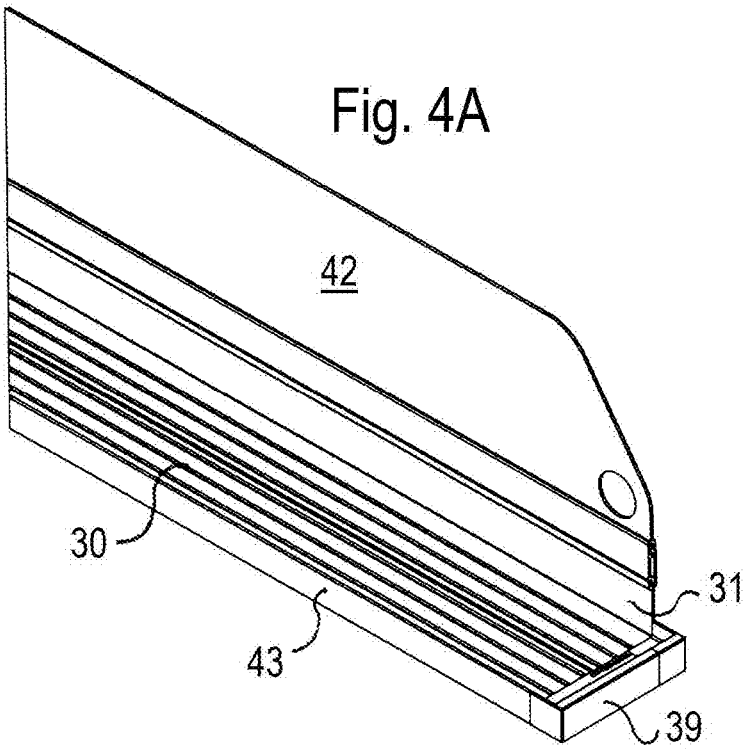
FIG. 4A is a schematic view of an individual shelf allocation and management unit according to one embodiment of the present invention showing a width adjustable unit set to a narrow width position.
Figure 4B:
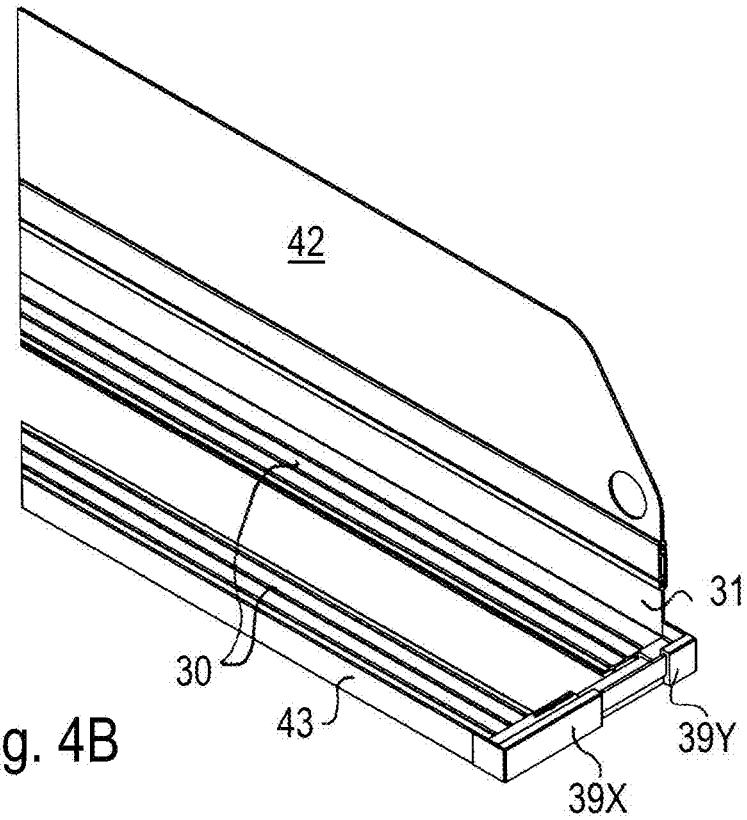
FIG. 4B is a schematic view of an individual shelf allocation and management unit according to one embodiment of the present invention showing a width adjustable unit set to a wide width position.

As shown in FIGS. 4A and 4B, the units 20 of the present invention address the installation problems described above by introducing a width adjustment mechanism 39 which allows the width of the base 30 of the unit 20 to be easily adjusted in width to fit a wide variety of yogurt cups 14 (and other dairy containers). In the present invention, the base 30 is split into two sections each 1.25" wide, and each of those sections is attached both at the front and the rear to width adjustment mechanism 39. When width adjusting mechanism 39 is adjusted to its shortest position the attached base 30 sections are brought together (touching) to form the narrowest width setting. Conversely, when mechanism 39 is lengthened then the attached base 30 sections are moved farther apart from each other thereby achieving a wider width setting. For example, when adjusted to the narrowest width, where the two base 30 sections are touching, the total base 30 width would be 2.50", and, when adjusted to the widest setting, where the two base 30 sections might be 1.25" apart, the total effective base width would be 3.75". The present invention preferably features seven different width settings between 2.50" and 3.75" although the width adjustment feature could be effective with between perhaps 5 and 12 width settings.

As show in FIG. 4B, in the present invention, the width adjusting mechanism 39 is comprised of two mating parts, 39X and 39Y, with 39X being the "female" part and 39Y being the "male" part. As the 39Y part is inserted into the 39X part the two halves of base 30 are brought together effectively narrowing the width of base 30, and vice versa. A wide variety of mechanisms could be used to achieve the desired adjustability and the specific mechanism described above is only one method. In the system 10 of the present invention, the width adjusting mechanisms 39 are positioned at the extreme front end and extreme rear end of the base 30 so that the location of the width adjusting mechanisms 39 is obvious and access to them is unimpeded. Further, the present invention features numbered width adjustment position indicators which allows clerks to easily repeat a width setting when installing the system 10 in rows of yogurt cups many of which are identical in width. Plus, the numbered width settings make it easy to ensure that the front and back widths are at the same setting.

Other yogurt shelf allocating and management systems use width adjusting mechanisms that are arranged along the length of the base 30 (for example 6" behind the front and 12" behind) and are more difficult to locate and can be awkward to operate. The width adjustment mechanism 39 of the present invention is designed for highly intuitive and obvious use and maximum speed of adjustment, which is important as a width adjustment mechanism that is non-intuitive and otherwise difficult to operate consumes too much time especially when many units 20 are being installed.

In addition to making the installation process simpler and faster, width adjustability of the units 20 also allows for easier and faster ordering of the system 10. For example, a store with 200 rows of yogurt cups that range in width from 2.60" to 4.80" (a typical range in most stores) could simply order 200 width-adjustable units 20 as opposed to being forced to undertake the tedious and time-consuming process of determining the width of each yogurt cup 14 and ordering a corresponding fixed-width unit 20.

A further feature of the present invention, as shown in FIG. 3, is that base coupling component 37 and divider coupling component 46 are configured to resist fouling by spilled yogurt and other debris. This is important as yogurt containers leak fairly often and even a small quantity of spilled yogurt may be enough to cause a sliding mechanism to become partially or entirely stuck or frozen. Specifically, divider coupling component 46 is designed to cover and shroud the coupling interface (with base coupling mechanism 37) so that any debris falling or dripping downward along the high divider/puller 42 travels harmlessly outside of rather than into/inside the coupling interface.

Figure 7:
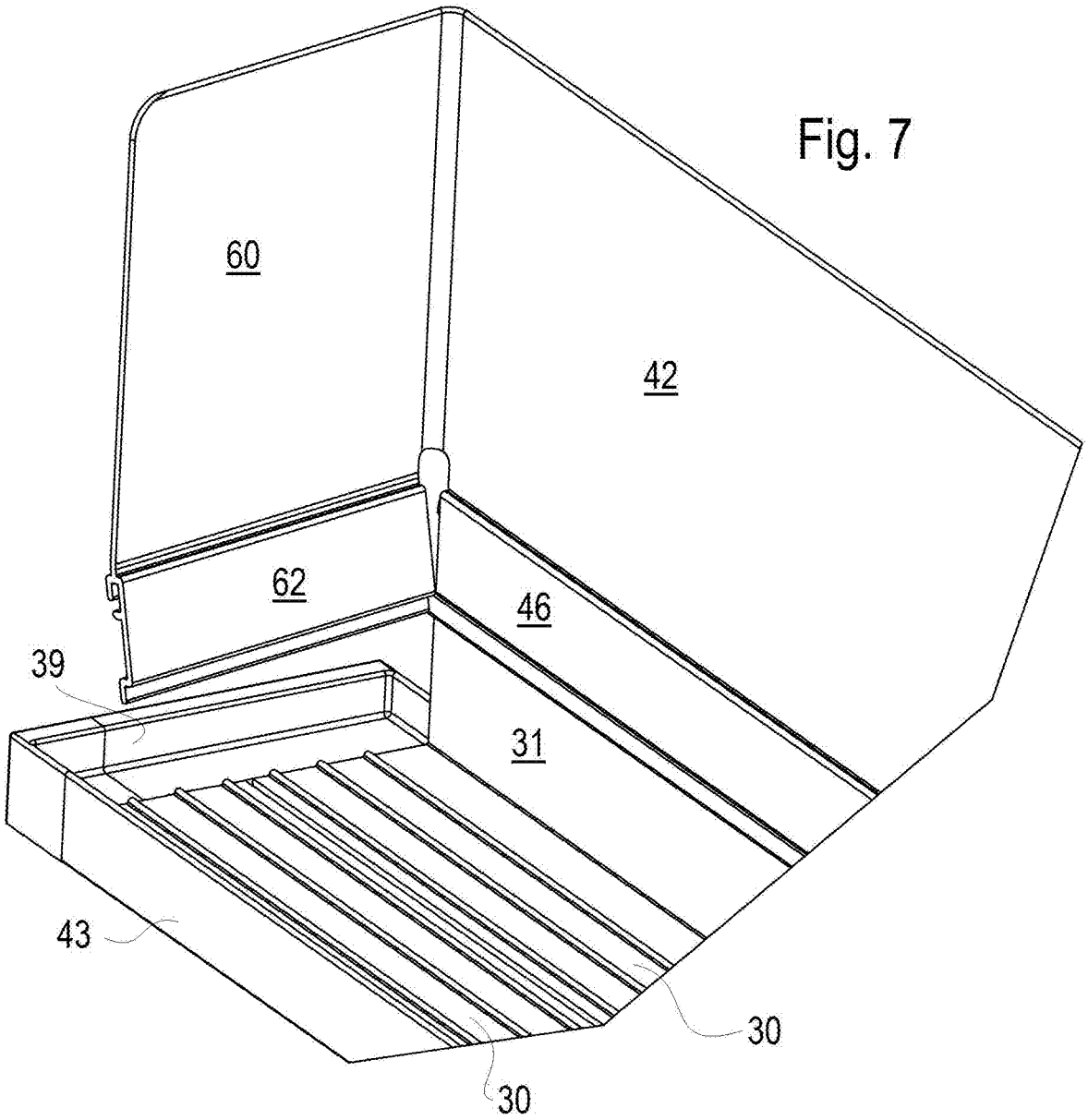
FIG. 7 is a schematic view of an individual shelf allocation and management unit showing a backstop that is configured to make more even contact with frusto-conical merchandise containers.

As seen in FIG. 7, a further element of the present invention is a backstop 60 that is configured to include backstop flare 62 which has the effect of changing the shape of backstop 60 to better conform to the shape of many yogurt cups and similar containers. The result is that, when backstop 60 and backstop flare 62 make contact with a merchandise 14 container, the force is applied more evenly so the merchandise 14 containers are more likely to be urged forward along base 30 rather than tipping over. For yogurt cups 14 and other frusto-conical shaped containers, where the top of the container 14 is wider than the base of the container, a backstop 60 that is uniformly vertical, at a 90-degree angle from the base 30, will, during a fronting operation when the backstop 60 is drawn forward, make contact with the top of the yogurt container 14 first with the effect being that the yogurt container may be tipped over forward rather than the entire container moving forward along base 30. Backstop flare 62 is at the bottom of backstop 60 and is essentially a forward bending of the bottom of backstop 60. The result is that the bottom of the backstop 60 is slightly forward of the top of the backstop 60 which corresponds to the shape of most yogurt and many other dairy containers (and also most ice cream pint containers). This backstop 60 shape better ensures that the backstop 60 will contact all points along the height of the yogurt cup with more even force.

As the purposes of any shelf management system such as the system 10 of the invention are to reduce the amount of labor required to stock shelves 12, to maintain merchandise 14 in proper selling position and to and generally maintain an attractive selling environment for shoppers, it follows that a shelf management system 10 should be easy to clean so it may be cleaned with the least amount of time spent. More than other food categories (e.g. salsa jars and canned beans) yogurt cups are prone to leakage either because of loose lids or because of container damage. Therefore, it is common for yogurt to spill and, if there is a shelf management system in use, the spilled yogurt finds its way to the base of that system. As shown in FIG. 2A, the base 30 of the present invention is designed to be as uniform and flat as possible and with the least amount of crevices so that spilled yogurt may be easily and quickly wiped away. Other yogurt shelf management systems have bases that are quite convoluted and are therefore difficult and time-consuming to clean.

A further aspect of the present invention, as shown in FIG. 9, provides for anti-skid material 38 to be placed on the bottom surface of the base 30 of a shelf management unit 20. So they may be properly positioned during installation, the individual shelf management units 20 of the system 10 are designed to move laterally to the left and to the right along the surface of the shelf 12. In some cases, though, lateral movement that amounts to free sliding is not desirable, and this is especially true in cases where large gaps exist, or could potentially exist, on either side of a shelf management unit 20. Where these gaps exist it is helpful if the bases 30 of the shelf management units 20 may be secured in position as with the use of magnets or other anti-skid material 38 being placed on the bottom surface of the base 30 which causes the base 30 to partially adhere to the shelf 12. Also, when the divider 42 is drawn forward to actuate the fronting operation, it is desirable that the unit 20 stays in position (the divider 42 and backstop 60 should come forward while the base 30 should remain stationary) as this would require the clerk to put the unit 20 back into proper position after each row fronting operation, which would be wasted time. As most store shelves 12 are made of steel, a magnetic strip 38 or strips positioned lengthwise along the underside of the base 30 may be the most effective means of achieving a blend of adhesion without firm attachment. Alternately, the anti-skid material 38 may be in the form of a releasable adhesive material. A moderate amount of adhesion is desirable so that just enough resistance to skidding is presented in order to keep the shelf management units 20 in proper position but not so much adhesion that the units 20 become virtually attached to the shelf 12 as this would make difficult the re-positioning of shelf management units 20 as is required during positioning during installation of the units 20 and also with new merchandise 14 cut-ins and merchandise 14 re-sets, etc.

It is understood, therefore, that this invention is not limited to the particular embodiments disclosed, but it is intended to cover modifications that are within the spirit and scope of the invention, as defined by the appended claims and equivalents thereto.

What is claimed is:

1. A bottom supporting shelf allocation and management system for allocating shelf space among rows of products, the system comprising:

a plurality of adjacent shelf allocating and managing units, each shelf allocating and managing unit associated with at least one row of products, wherein each shelf allocating and managing unit includes:

a base substantially corresponding in length to a depth of a shelf, where the base is adapted to rest on the shelf and to support the at least one row of products, wherein the base is width adjustable including two adjustable base sections, wherein the two adjustable base sections are coupled to a first width adjusting mechanism at a front end of each adjustable base section located in a first direction along the length of the base and to a second width adjusting mechanism at a rear end of each adjustable base section located in a second direction along the length of the base, whereby the first width adjusting mechanism extends beyond the front end of each adjustable base section in the first direction and the second width adjusting mechanism extends beyond the rear end of each adjustable base section in the second direction, a manually movable side divider coupled to an elevating rail attached to a side edge of the base and extending vertically above the base, wherein the manually movable side divider is removeably coupled to the elevating rail through a coupling of the manually movable side divider and the elevating rail and where the coupling of the manually movable side divider and the elevating rail holds the manually movable side divider and the base in a fixed lateral and vertical position but enables the manually movable side divider to manually slide forward and backward along the length of the base while the base remains stationary, a backstop attached to a rear of the manually movable side divider and protruding laterally across the base which is configured, when the manually movable side divider is manually drawn forward, to make contact with a rearmost product resting on a product supporting surface of the base and will push the products on the product supporting surface of the base forward as the side divider is manually drawn forward.

2. The bottom supporting shelf allocation and management system for allocating shelf space among rows of products according to claim 1 wherein the manually movable side divider of each shelf allocating and managing unit has a wall thickness of about 0.045".

3. The bottom supporting shelf allocation and management system for allocating shelf space among rows of products according to claim 2 wherein the coupling of the manually movable side divider and the elevating rail of each shelf allocating and managing unit includes an upper downwardly facing groove on the manually movable side divider engaged by a tongue element of the elevating rail and a lower upwardly facing groove on the elevating rail engaged by a tongue element of the manually movable side divider.

4. The bottom supporting shelf allocation and management system for allocating shelf space among rows of products according to claim 1 and where a side of the base of each shelf allocating and managing unit opposite the side to which the manually movable side divider is attached includes a fixed side divider extending 0.30" above the product supporting surface of the base.

5. The bottom supporting shelf allocation and management system for allocating shelf space among rows of products according to claim 4 further including support ribs running along an underside of each a base section of each shelf allocating and managing unit on a side opposite of the product supporting surface.

6. The bottom supporting shelf allocation and management system for allocating shelf space among rows of products according to claim 5 wherein the coupling of the manually movable side divider and the elevating rail of each shelf allocating and managing unit includes an upper downwardly facing groove on the manually movable side divider engaged by a tongue element of the elevating rail and a lower upwardly facing groove on the elevating rail engaged by a tongue element of the manually movable side divider.

7. The bottom supporting shelf allocation and management system for allocating shelf space among rows of products according to claim 4 wherein the coupling of the manually movable side divider and the elevating rail of each shelf allocating and managing unit includes an upper downwardly facing groove on the manually movable side divider engaged by a tongue element of the elevating rail and a lower upwardly facing groove on the elevating rail engaged by a tongue element of the manually movable side divider.

8. The bottom supporting shelf allocation and management system for allocating shelf space among rows of products according to claim 1 wherein the coupling of the manually movable side divider and the elevating rail of each shelf allocating and managing unit includes an upper downwardly facing groove on the manually movable side divider engaged by a tongue element of the elevating rail and a lower upwardly facing groove on the elevating rail engaged by a tongue element of the manually movable side divider.

9. A bottom supporting shelf allocation and management unit for a row of products, the unit comprises:

a base substantially corresponding in length to a depth of a shelf where the base is adapted to rest on the shelf and to support the at least one row of products wherein the base is width adjustable including two adjustable base sections, wherein the two adjustable base sections are coupled to a first width adjusting mechanism at a front end of each adjustable base section located in a first direction along the length of the base and to a second width adjusting mechanism at a rear end of each adjustable base section located in a second direction along the length of the base, whereby the first width adjusting mechanism extends beyond the front end of each adjustable base section in the first direction and the second width adjusting mechanism extends beyond the rear end of each adjustable base section in the second direction;

a manually movable side divider coupled to an elevating rail attached to a side edge of the base and extending vertically above the base, wherein the manually movable side divider is removeably coupled to the elevating rail through a coupling of the manually movable side divider and the elevating rail and where the coupling of the manually movable side divider and the elevating rail holds the manually movable side divider and the base in a fixed lateral and vertical position but enables the manually movable side divider to manually slide forward and backward along the length of the base while the base remains stationary; and a backstop attached to a rear of the manually movable side divider and protruding laterally across the base which is configured, when the manually movable side divider is manually drawn forward, to make contact with a rearmost product resting on a product supporting surface of the base and will push products on the product supporting surface of the base forward as the manually movable side divider is manually drawn forward.

10. The bottom supporting shelf allocation and management unit for a row of products according to claim 9 wherein the coupling of the manually movable side divider and the elevating rail includes an upper downwardly facing groove on the manually movable side divider engaged by a tongue element of the elevating rail and a lower upwardly facing groove on the elevating rail engaged by a tongue element of the manually movable side divider.

* * * * *